US008763677B2

(12) United States Patent
Menge et al.

(10) Patent No.: US 8,763,677 B2
(45) Date of Patent: Jul. 1, 2014

(54) METHOD FOR PROCESSING, IN PARTICULAR CASTING, A MATERIAL, CASTING MOULD FOR CARRYING OUT THE METHOD AND ARTICLES PRODUCED BY THE METHOD OR IN THE CASTING MOULD

(75) Inventors: Marc Menge, Braunschweig (DE); Holger Oppelt, Bad Suderode (DE); Uwe Lange, Wernigerode (DE)

(73) Assignee: KSM Castings Group GmbH, Hildesheim (DE)

( * ) Notice: Subject to any disclaimer, the term of this patent is extended or adjusted under 35 U.S.C. 154(b) by 1056 days.

(21) Appl. No.: 12/448,123

(22) PCT Filed: Dec. 4, 2007

(86) PCT No.: PCT/DE2007/002176
§ 371 (c)(1),
(2), (4) Date: Feb. 17, 2010

(87) PCT Pub. No.: WO2008/071152
PCT Pub. Date: Jun. 19, 2008

(65) Prior Publication Data

US 2010/0166596 A1 Jul. 1, 2010

(30) Foreign Application Priority Data

Dec. 9, 2006 (DE) ..... 10 2006 058 145

(51) Int. Cl.
*B22D 35/04* (2006.01)

(52) U.S. Cl.
USPC ..... 164/136; 164/336

(58) Field of Classification Search
USPC ..... 164/136, 336
See application file for complete search history.

(56) References Cited

U.S. PATENT DOCUMENTS

| | | | |
|---|---|---|---|
| 5,492,165 | A | 2/1996 | Erana |
| 5,524,700 | A | 6/1996 | Gosch |
| 5,704,413 | A | 1/1998 | Takasaki et al. |
| 6,244,328 | B1 | 6/2001 | Grolla |

(Continued)

FOREIGN PATENT DOCUMENTS

| | | |
|---|---|---|
| CN | 85 1 05357 | 9/1987 |
| DE | 2000 004 | 7/1971 |

(Continued)

OTHER PUBLICATIONS

Dipl.-Ing. Ernst Brunhuber, Praxis der Druckguμfertigung, Fachverlag Schiele & Schön GmbH, Berlin, Aug. 18, 1981, p. 215.

(Continued)

*Primary Examiner* — Kevin P Kerns
(74) *Attorney, Agent, or Firm* — Collard & Roe, P.C.

(57) ABSTRACT

A method for producing articles in a mold includes bringing a material into a free-flowing state, introducing the material into the mold via a bottom-casting principle, and solidifying being carried out according to a top-casting principle. The material, viewed in a flow direction of the material, is first introduced into a pouring basin of a runner, then flows through the runner, thereafter through a storage space that is located upstream from a cavity and that is arranged underneath the cavity, and from there into the cavity. Thereafter the mold including the sub-parts of the mold is pivoted so that the storage space takes over the function of a feeder or riser.

12 Claims, 2 Drawing Sheets

(56) References Cited

U.S. PATENT DOCUMENTS

| | | | | |
|---|---|---|---|---|
| 6,540,007 | B2 * | 4/2003 | Meyer | 164/119 |
| 6,929,053 | B1 * | 8/2005 | Doty | 164/136 |
| 7,296,612 | B2 | 11/2007 | Bend | |
| 7,926,544 | B2 | 4/2011 | Greif et al. | |
| 2002/0000304 | A1 | 1/2002 | Kahn et al. | |
| 2004/0045693 | A1 * | 3/2004 | Watanabe et al. | 164/122.1 |
| 2007/0062666 | A1 | 3/2007 | Bend | |
| 2012/0012272 | A1 | 1/2012 | Smetan et al. | |

FOREIGN PATENT DOCUMENTS

| | | |
|---|---|---|
| DE | 7230197 | 11/1972 |
| DE | 2 164 755 | 7/1973 |
| DE | 43 04 622 | 8/1994 |
| DE | 693 13 180 | 1/1998 |
| DE | 196 49 014 | 5/1998 |
| DE | 197 20 056 | 11/1998 |
| DE | 100 19 309 | 10/2001 |
| DE | 20 2004 020 881 | 3/2006 |
| DE | 10 2005 060826 | 6/2007 |
| EP | 0 234 877 | 9/1987 |
| EP | 0 572 058 | 12/1993 |
| EP | 0 599 768 | 6/1994 |
| JP | 11 291022 | 10/1999 |
| WO | WO 2004/039516 | 5/2004 |

OTHER PUBLICATIONS

International Search Report, mailed Apr. 17, 2008.

* cited by examiner

Prior Art
1A
4a
5a
2a
1a
6
7
8

1B
4b
5b
2b
1b 1C
2C
1c 3
1D
2d'
2d
1d 1E
1E'
1E"
4a
10
I
7a
9
1e 2a
6a
4a
9
1E
I
1e 5C
12
6a
4c
11
III
1E
7
II
1e
7a
9
8a

METHOD FOR PROCESSING, IN PARTICULAR CASTING, A MATERIAL, CASTING MOULD FOR CARRYING OUT THE METHOD AND ARTICLES PRODUCED BY THE METHOD OR IN THE CASTING MOULD

Method for processing, in particular casting, a material, casting mould for carrying out the method and articles produced by the method and articles produced by the method or in the casting mould

CROSS REFERENCE TO RELATED APPLICATIONS

This application is the National Stage of PCT/DE2007/002176 filed on Dec. 4, 2007, which claims priority under 35 U.S.C. §119 of German Application No. 10 2006 058 145.8 filed on Dec. 9, 2006. The international application under PCT article 21(2) was not published in English.

BACKGROUND OF THE INVENTION

1. Field of the Invention

The invention relates to a process for processing a material which initially is brought from its solid state into a free-flowing state and forthwith introduced into a mould, in which the material is then induced to solidify. Further, the invention relates to moulds for carrying out the method and to articles which are being or have been produced according to the method and/or in such moulds.

2. The Prior Art

Basically, there are four commonly used casting methods, mainly gravity casting methods, i.e. bottom-casting, side-casting, top-casting and tilt-casting, which, although they all have certain advantages when compared in relation to each other, they also all have certain disadvantages.

For example, bottom-casting achieves the most laminar mould filling, but the coldest material during the solidifying process is in the said feeder/riser, i.e. the storage space, from where during solidifying additional material is to be fed so that here topping-up must be ensured by providing larger feeder dimensions.

With side-casting, albeit, the material in the feeder is relatively hot, but mould filling is more turbulent than with bottom-casting.

With top-casting the hottest material is in the feeder or riser so that topping-up is good for a minimum feeder volume, but the quality of the castings deteriorates due to turbulence as a function of the filling height.

With tilt-casting, where again the hottest material is in the feeder, undesired swirls and flow lines appear on the casting surface. The contour of the casting determines the flow direction of the liquid material which, in turn, leads to overheated areas in the mould and thus also in the casting.

SUMMARY OF THE INVENTION

It is the requirement of the present invention to avoid the disadvantages of the previously known casting methods and to develop methods for processing materials which, for optimum turbulence-free laminar mould filling, also allow optimum topping-up with the hottest metal coming from a storage space thereby permitting smaller storage or feeder volumes. In addition overheating from contour-related material accumulations is to be avoided and savings are to be achieved in the cycle, material, energy, transport and machining outputs.

Further, the production of large-surface and complicated castings shall be simplified and thus become cheaper. A further requirement aspect consisted in the creation of respective casting moulds for the cost-effective and high-quality production of castings.

According to the invention the process for processing materials by bringing the same into a free-flowing state and introducing them into a mould is initially characterised in that introducing into the mould is carried out according to the principle of bottom-casting and solidifying is carried out according to the principle of top-casting. In other words, the material is initially brought into a free-flowing state by heating and introduced into a casting mould or into the hollow space or cavity of the mould according to the principle of bottom-casting, and solidifying is carried out according to the principle of top-/tilt-casting.

Introducing the material into the cavity of the casting mould is carried out from the bottom through a pouring run, as is common for bottom-casting, by initially introducing the melt from the top into a pouring basin higher, at least in part, than the cavity, from there through a downwardly directed inflow, then upwards via a bend—the inlet—into a storage space situated below the cavity and through the outlet thereof into the cavity, and solidifying then takes place with the storage space at the top, as is common for top-casting, by pivoting the mould prior to solidifying the material so that the storage space now assumes the function of the feeder/riser.

In order to avoid spilling out of the melt from the pouring basin during pivoting and thereafter, it may be advantageous if a slide arranged in the pouring run in front of the cavity—when viewed in flow direction of the melt—is activated in good time prior to or during pivoting of the mould.

Alternatively, instead of a slide a closure may be provided on top of the pouring basin, which closure is activated prior to pivoting.

It is convenient if the mould is pivoted about an axis which extends, at least approximately, in parallel to the separating-groove plane or separating-groove planes of the mould.

Furthermore, it may be of advantage if the cavity and the pouring run and thus also the separating-groove(s) or separating-groove(s) plane(s) are provided or arranged at an angle to each other. Either the pouring run or the cavity may extend obliquely, or both the cavity and the pouring run may be arranged at an oblique angle to the horizontal, whereby cavity and pouring run may enclose a blunt angle between them. But it is also possible for cavity and/or pouring run to extend at a shallow angle in relation to the horizontal.

It may be particularly advantageous if cavity and pouring basin are arranged at such an angle to each other and are jointly pivoted about such an angle and in such a direction that, when reaching a position of the storage space where the storage space can assume the function of the feeder or riser, the pouring run has not yet reached the horizontal, whereby it is especially advantageous if pivoting of the mould is carried out in a direction such that the pouring run is leading so that in the solidifying position the pouring run points upwards, at least slightly, thus making it impossible for the melt to spill out from the storage space which, as already mentioned, then acts as a feeder or riser.

A further development of the invention relates to a casting mould or ingot mould which below the cavity has a storage space into which the pouring run leads, whereby the area of the pouring run leading into the storage space has a portion—the inlet—, which lies lower than the storage space.

The casting mould may further be characterised in that the cavity and the pouring run are provided not so as to extend in parallel to each other, but at an angle to each other. The casting mould or ingot mould may be shaped in such a way that both, i.e. cavity and pouring run, are inclined, possibly forming a blunt angle in relation to each other. The angle may be chosen such that when the mould is pivoted into a position in which the storage space comes to lie above the cavity—i.e. the solidifying position—and the storage space is able to act as feeder or riser, the pouring run finds itself in a position where spilling out of melt from the storage space is avoided, in that the storage space, at least with a part of it, projects at least slightly upwards in relation to the horizontal. It is advantageous if the pouring run is shaped in such a way that cavity and pouring run are arranged relative to one another in such a way and the mould is pivoted in such a way that the pouring run is leading.

The pivotable casting mould where the mould halves surrounding both the pouring run and the storage space as well as the cavity are separated from each other by respective separating-grooves is conveniently shaped in such a way that pivoting is carried out about an axis which, at least approximately, extends in parallel to the plane of the separating-groove plane.

This casting mould—with the storage container at the bottom—is fillable with melt according to the bottom-casting principle, whereby the storage space lies below the cavity and solidifying of the melt is carried out within the pivoted casting mould—with the storage space then acting as feeder or riser now at the top.

In order to avoid the melt from spilling out during or after pivoting it may also be advantageous if the casting mould comprises a closure on top of the pouring basin or a slide in the area of the pouring run, whereby closure or slide are activated prior to, or in good time during pivoting.

Moreover the invention relates to casting products being or having been produced by the inventive method and/or by means of the casting moulds according to the invention, whereby these casting products produced by the gravity-casting method in an especially convenient and advantageous manner consist of light-metal alloys such as, in particular, aluminium alloys.

BRIEF DESCRIPTION OF THE DRAWINGS

The invention will now be explained further with reference to the FIGS. 1 to 9.

FIG. 1 schematically shows the casting method using so-called bottom-casting, FIG. 2 shows the casting method using side-casting, FIG. 3 shows the casting method using top-casting, and FIG. 4 shows the casting method using tilt-casting.

FIG. 5 shows a first step of the method of the invention.

FIG. 6 shows a second step of the method according to the invention.

FIG. 7 shows an intermediate position of the mold of FIG. 5 after the mold has been pivoted by approximately 90°.

FIG. 8 shows another mold according to the invention with parts arranged at a blunt angle to each other.

FIG. 9 shows the mold of FIG. 8 after pivotation.

DETAILED DESCRIPTION OF THE PREFERRED EMBODIMENTS

In FIGS. 1 to 4 the casting mould or ingot mould is designated 1A, 1B, 1C and 1D respectively and the hollow space of the mould or the cavity is designated 1*a* to 1*d* respectively.

In each of FIGS. 1 to 4 a feeder or riser 2*a* to 2*d* is provided from which so-called topping-up may be carried out while the cast is solidifying.

Figures 1, 2, 3, 4, 5, 6, 7:
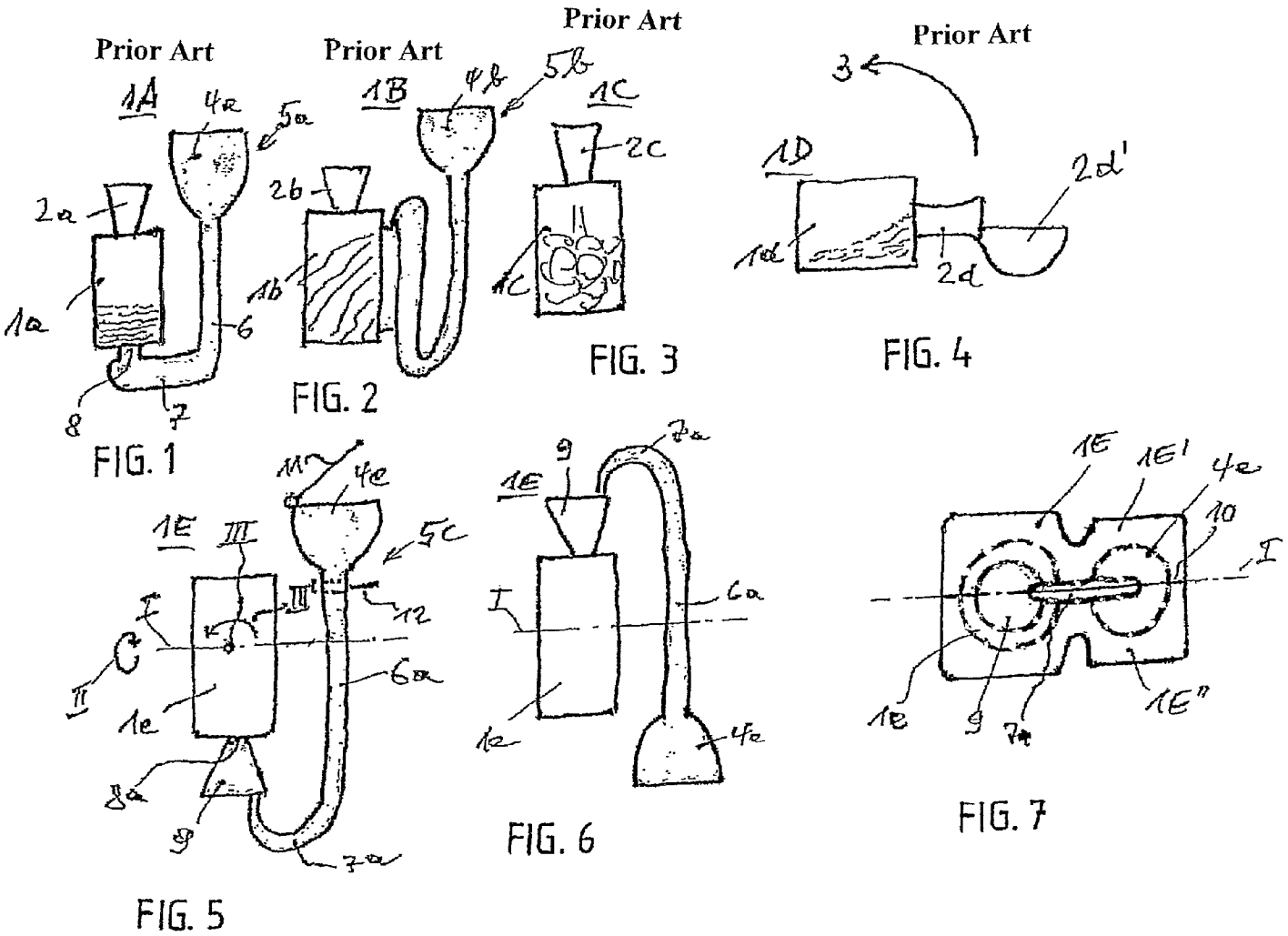
FIG. 1 Prior Art
FIG. 2 Prior Art
FIG. 3 Prior Art
FIGS. 1 to 4 show traditional prior art casting methods and FIGS. 5 to 9 show the casting method according to the invention.

With bottom-casting, side-casting and top-casting according to FIGS. 1 to 3 the casting moulds stand upright and in FIGS. 1 and 2 the melt is introduced via the pouring basins 4*a*, 4*b*. With top-casting according to FIG. 3 and with tilt-casting according to FIG. 4 the riser 2*c*, 2*d* also acts as pouring basin. With tilt-casting according to FIG. 4—in the example shown here—the melt is initially introduced into the container 2*d* with the ingot mould 1D in a horizontal state, and the mould 1D is pivoted in the direction of arrow 3, the melt flows through the feeder 2*d* until the ingot mould stands upright, and in this position solidifying of the material takes place with the feeder 2*d* at the top.

With bottom-casting and side-casting according to FIGS. 1 and 2 the material is initially fed via grey-shaded pouring run 5*a*, 5*b* respectively, into the pouring basin and from there into the cavity 1*a*, 1*b*. With bottom-casting according to FIG. 1 the pouring basin 4*a* is connected to inlet 6 which becomes an inlet area 7 which in this case lies lower than cavity 1*a*, and the melt enters cavity 1*a* through outlet 8.

It can be seen that in bottom-casting according FIG. 1 a filling of the mould is achieved which is at its most laminar.

With side-casting according to FIG. 2 the mould is filled by excessively raising the bath level in the outlet in the hollow space of the mould, and the filling is thus less laminar than with bottom-casting.

With top-casting according to FIG. 3 mould filling is at its most turbulent leading to a greater enrichment of the melt with oxides, gas bubbles and foam.

With tilt-casting according to FIG. 4 distinct flow lines appear. Additionally the flow direction of the material is determined by the contour of the casting and as a consequence, leads to overheated areas in the mould which in turn give rise to faults in the casting.

With casting by the tilt-casting method according to FIG. 4 and the top-casting method according to FIG. 3, the hottest material is always in the feeder, which results in optimum topping-up, but the mould is filled, not in the desired laminar, but in a turbulent manner.

With bottom-casting according to FIG. 1, as already mentioned, mould filling is at its most laminar, with side-casting according to FIG. 2 the result as regards laminar filling is less good, and both casting methods, i.e. bottom-casting and side-casting suffer from the disadvantage that the coldest material is in the feeder or riser so that during solidifying larger feeders are a must in order to achieve optimum topping-up.

With the present invention which will now be explained in more detail with reference to FIGS. 5, 6 and 7 the advantages of bottom-casting and side-casting, that is optimum laminar mould filling, are combined with the advantage that during solidifying the hottest metal is in the feeder.

As shown in FIG. 5 filling of the casting mould indicated by 1E is practically the same as in FIG. 1, that is by the bottom-casting method, with the melt reaching cavity 1*e* by passing through pouring run 5*c* also shown grey-shaded. The melt filled into pouring basin 4*e* flows to the bottom through inflow 6*a*, through the area extending below a storage space 9 in this case, through inlet 7*a*, through storage space 9 and from there through outlet 8*a* of storage space 9 into cavity 1*e*. Prior to solidifying the material, for example as a function of a certain temperature, the whole casting mould 1E is pivoted as illustrated in FIG. 6, here by approximately 180° about axis I corresponding to rotating direction II. This causes storage space 9 to be at the top so that this storage space 9 is now acting as a feeder or riser until the material has solidified.

FIG. 7 shows a position of the casting mould or ingot mould 1E after it has been pivoted by approximately 90° from its position in FIG. 5. In this figure the separating groove 10 between the two mould halves 1E' and 1E" can be seen and also the pivoting axis I which extends in parallel to and through the plane formed by the separating grooves 10. FIG. 7 also shows the face of cavity 1*e* and the face of storage space 9 as well as the inlet 7*a* and the pouring basin 4*e*.

In many cases it will not matter whether in the position of FIG. 6 melt spills out of pouring basin 4*e*, inflow 6*a* or inlet 7*a*, since by then the melt present in there is no longer needed for the subsequent phases of the casting process.

It may be convenient if the ingot mould 1E is moved quickly between the position it occupies shortly before it reaches the position shown in FIG. 7 and a position shortly thereafter, so that it is practically not possible for melt to spill from the cavity and the storage container. In the area of the pouring basin 4*e* however, a closure 11 may be provided, or a slide 12 in the area of the inflow, which are activated in good time before or during pivoting, so that the pouring run is closed there.

Alternatively pivoting may be effected about an axis other than the horizontal axis or an axis extending, at least approximately, in parallel to the plane of the separating groove 10, for example about axis III extending, at least approximately, perpendicularly thereto. It can be advantageous if pivoting is effected in direction of arrow III' so that the pouring run or the pouring basin is leading and melt cannot spill out from the same until the storage container 9 has at least reached a position where it is at the top. But pivoting may also be effected about other axes than the axes and curves illustrated, for example about axes or curves which are a combination of those shown; where a closure or slide is used the rotating direction is less important as regards the escaping of melt from the pouring run.

Figure 8:
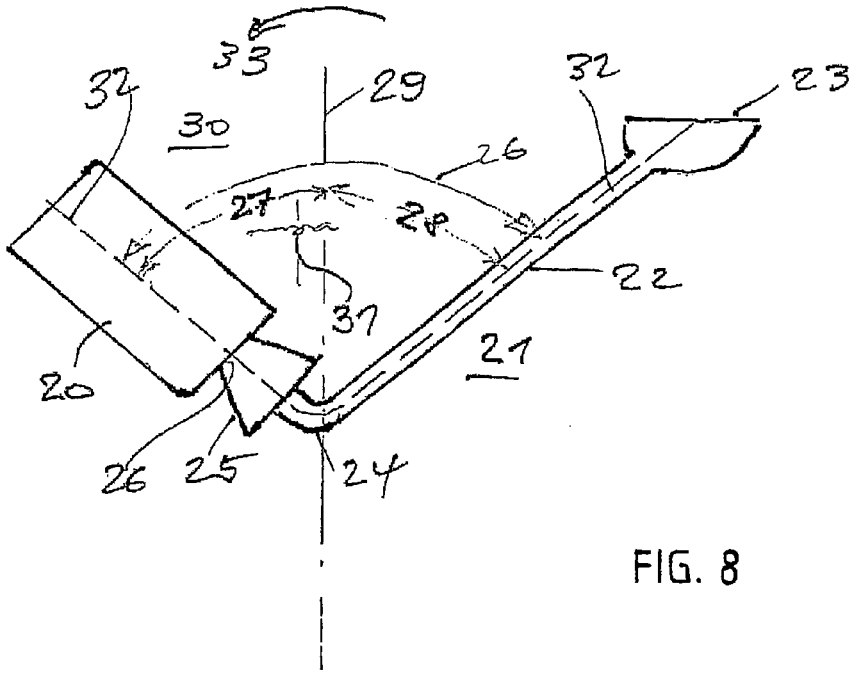
Figure 9:
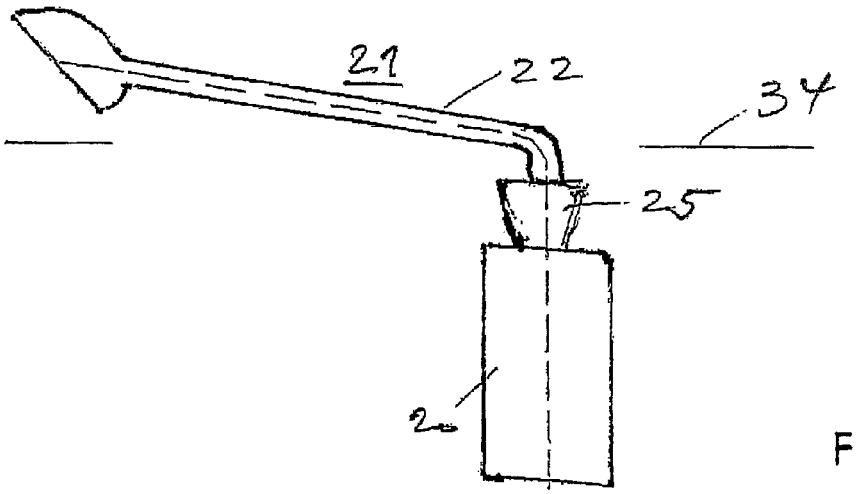

In FIGS. 8 and 9 cavity 20 and at least parts of pouring run 21, i.e. inflow 22, are arranged at an angle to each other, in this case at a blunt angle.

Again one can recognise pouring basin 23 and bent inlet 24 which leads into storage space 25, and that the latter changes via an outlet 26 into the cavity. Cavity 20, storage space 25 and inlet 24 may be arranged in relation to each other such that inlet 24 lies lower than storage space 25 and this, in turn, lies lower than cavity 20. But it may also be advantageous or sufficient in some cases if inlet 24 is not arranged below storage space 25. In FIGS. 8 and 9 cavity and inflow, as already mentioned, are provided to extend at a blunt angle 26 in relation to each other and both enclose an angle 27 and 28, respectively, in relation to a plane 29 which extends, at least approximately, perpendicularly to the horizontal.

After introducing the melt and in good time before the same solidifies, mold 30 is pivoted into the position shown in FIG. 9, i.e. about axis 31 which extends, at least approximately, in parallel to separating groove 32 of mould 30, i.e. conveniently in a pivoting direction of arrow 33 so that pouring run 21 with pouring basin 23 are leading until in a position in FIG. 9, in which cavity 20 is brought into such a position that storage space 25 is now above cavity 20 and can assume the function of a feeder or riser. In the viewpoint shown in FIG. 8, axis 31 projects at a 90° angle into and out of the plane of the paper (at the center of the + sign shown in FIG. 8) and the separating groove 32 also projects at a 90° angle into and out of the plane of the paper.

Pivoting here has reached a point, where inflow 22 has not quite yet reached horizontal 34, therefore no melt or only very little melt can spill out.

It can be seen that the method according to the invention or that the casting moulds according to the invention make it possible to carry out casting according to the bottom-casting principle with optimum laminar mould filling compared to other casting methods and to effect solidifying according to the top-casting principle which, again, results in the best possible topping-up.

The invention further relates to casting moulds which are produced by the method according to the invention and/or in the casting moulds according to the invention. Although the method according to the invention is especially suitable for the processing of light-metal, in particular light-metal alloys such as aluminium alloys, the invention is not limited to the use of light-metal alloys but other materials, such as also non-metallic materials, can be processed according to the invention.

LIST OF REFERENCE SYMBOLS

1A to 1E casting mold
1*a* to 1*e* cavity
2*a* to 2*d* feeder/riser
2*d*' container
3 arrow
4*a* to 4E pouring basin
5*a*,5*b*,5*c* pouring run
6 inflow
7, 7*a* inlet
8, 8*a* outlet
9 storage container
I axis
10 separating groove
1E ingot mold (casting mold)
1E', 1E" mold halves
11 closure
12 slide
20 cavity
21 pouring run
22 inlet
23 pouring basin
24 inlet
25 storage space
26 angle
27, 28 angles
29 horizontal plane
30 mold
31 axis
32 separating groove
33 pivoting direction

The invention claimed is:

1. A method for casting a material by bringing the material into a free-flowing state by heating and introducing the material into a casting mold according to a principle of gravity casting, wherein introducing the material into a cavity of the casting mold takes place from underneath by a bottom-casting principle, wherein the material—viewed in flow direction of the material—is first introduced into a pouring basin of a runner, then flows through the runner, thereafter through a storage space located upstream from the cavity and arranged underneath the cavity and from there into the cavity, wherein during the introduction of the material into the casting mold according to the principle of gravity casting, the pouring basin is disposed above the cavity, wherein after introduction of the material into the casting mold the casting mold is pivoted together with the pouring basin, the runner and the storage space, so that the storage space takes over the function of a feeder or riser and solidifying of the material takes place by a top-casting principle, and wherein the pouring basin is disposed above the cavity before the pivoting of the casting mold and the pouring basin.

2. The method according to claim 1, wherein the runner comprises an area which during introduction of the material lies lower than the storage space.

3. The method according to claim 1, wherein a slide is provided in the runner and the cavity, which slide is activated prior to pivoting.

4. The method according to claim 3, wherein a closure is provided on top of the pouring basin of the casting mold which closure is activated prior to pivoting.

5. The method according to claim 1, wherein pivoting of the mold is performed about an axis which, at least approximately, extends in parallel to its separating-groove plane or planes.

6. The method according to claim 1, wherein the cavity and the runner are arranged at an angle to each other.

7. The method according to claim 6, wherein both the cavity and the runner are arranged at an angle to a horizontal plane extending between them.

8. The method according to claim 6, wherein the cavity and the runner enclose a blunt angle between them.

9. The method according to claim 6, wherein the cavity and/or the runner form a blunt angle in relation to a horizontal plane.

10. The method according to claim 6, wherein the cavity and the runner are provided at such an angle in relation to each other and are pivoted about a pivotal axis at such an angle and in such a direction that when a position of the storage space is reached in which the storage space can assume the feeder or riser function, the runner has not yet reached the horizontal.

11. The method according to claim 1, wherein pivoting of the mold is carried out in such a direction that the runner of the cavity is leading.

12. The method according to claim 1, wherein the material brought into a free-flowing state flows from the pouring basin through the runner, namely a downsprue attached to the pouring basin and an inlet attached thereto, then further into the storage space, wherein the inlet is disposed at least in part lower than the storage space, further through an outlet of the storage space into the cavity of the casting mold, wherein the storage space is disposed at least in part lower than the cavity, and wherein the casting mold of the pouring basin, the downsprue, the inlet, the storage space, the outlet and the cavity, prior to solidification of the material, is pivoted such that the storage space acts as a feeder or riser.

* * * * *